United States Patent [19]

Fadeev et al.

[11] Patent Number: 4,796,956

[45] Date of Patent: Jan. 10, 1989

[54] MACHINE FOR DRIVING WORKINGS IN HARD ROCKS

[75] Inventors: Petr Y. Fadeev, Moscow; Vladimir Y. Fadeev; Vladlen V. Korobko, both of Novosibirsk; Rim A. Kulagin; Nikolai P. Ermilov, both of Novosibirsk, all of U.S.S.R.

[73] Assignee: Spetsialnoe Konstruktorskoe Bjuro Gidroimpulsnoi Tekhniki, Novosibirsk, U.S.S.R.

[21] Appl. No.: 35,585

[22] PCT Filed: Jul. 30, 1985

[86] PCT No.: PCT/SU85/00064

§ 371 Date: Mar. 30, 1987

§ 102(e) Date: Mar. 30, 1987

[87] PCT Pub. No.: WO87/00885

PCT Pub. Date: Feb. 12, 1987

[51] Int. Cl.[4] ..... E21C 29/28

[52] U.S. Cl. ..... 299/69; 267/64.15

[58] Field of Search ..... 299/62, 69, 70; 92/143; 267/14.15

[56] References Cited

U.S. PATENT DOCUMENTS 2,159,855 5/1939 Laugaudin ..... 267/64.15
2,614,833 10/1952 Laugaudin ..... 267/64.15
4,300,802 11/1981 Mitin et al. ..... 299/70 X
4,379,595 4/1983 Roussin et al. ..... 299/14 X
4,593,768 6/1986 Eklöf ..... 92/143 X

FOREIGN PATENT DOCUMENTS 2193138 2/1974 France .

*Primary Examiner*—Stephen J. Novosad
*Assistant Examiner*—William P. Neuder
*Attorney, Agent, or Firm*—Fleit, Jacobson, Cohn & Price

[57] ABSTRACT

A machine for driving workings in hard rocks comprises a movable carrier (1) having a boom (2) to which is secured a frame (4). An implement (9) having a hammer piston (10) is mounted in the frame (4) by pins (8). The pins (8) have support members (7) cooperating with piston rods (12) of shock-absorbing elements (11) comprising cylinders. Each shock-absorbing elements (11) has a space filled with a compressible fluid in which the end face of the piston rod (12) is received, and a first and second dashpot spaces filled with a non-compressible fluid which communicate with one another through a throttling device. The piston rod (12) has an enlarged piston-like portion which forces the non-compressible fluid to overlfow through the throttling device between the first and second dashpot spaces during movement of the piston rod (12).

8 Claims, 3 Drawing Sheets

MACHINE FOR DRIVING WORKINGS IN HARD ROCKS

TECHNICAL FIELD

The invention relates to driving machines with a selective action boom implement, and, more specifically, it deals with machines for driving workings in hard rocks.

The invention may be most advantageously used in the mining industry, e.g. for driving workings in hard rocks by percussive rock breaking.

In addition, the invention may also be used in the mining and construction industries in machines having a percussive implement for crushing oversized rock lumps, demolishing foundations and walls of buildings, breaking road paving, for preparing rock bed for erecting dams and other water engineering structures, and the like.

BACKGROUND ART

Known in the art is a machine for driving workings in hard rocks referred to as a heading combine (cf. French Pat. No. 2,193,138, Int. Cl. E 21 C 35/06, publ. Feb. 15, 1974), comprising a base plate; a first carriage mounted on the base-plate; a trough-shaped carrier secured to the first carriage for rotation about the vertical axis; a boom extending in parallel with the longitudinal axis of the baseplate mounted for rotation on the trough-shaped carrier about the horizontal axis and about its own longitudinal axis; a platform mounted on the boom for rotation about a horizontal pivot pin mounted on, or adjacent to the outer end of the boom; a second carriage for installation of the implement, which is mounted for sliding with respect to the platform.

The first carriage is movable longitudinally along the baseplate by means of double-action hydraulic jacks.

The trough-shaped carrier is rotatable about the vertical axis with respect to the first carriage on which it is mounted by means of double-action hydraulic jacks.

The boom mounted on the trough-shaped carrier is rotatable about the horizontal axis up and down under the action of a pair of double-action hydraulic jacks. In addition, the boom is rotatable about its own longitudinal axis by a hydraulic drive.

The platform is mounted on the front end part of the boom for rotation with respect to the boom under the action of respective double-action hydraulic jacks.

The second carriage, which is mounted on the platform and designed for the installation of the implement, is movable by a double-action hydraulic jacks along the longitudinal axis of the platform.

All jacks are actuated by a hydraulic system including an oil tank, a pump having a drive, a system of pipelines, various control and safety valves. The hydraulic system is manually controlled from the operator's workplace on the trough-shaped carrier.

By moving the abovementioned members, the implement is brought up to, and pressed with its tool against the rock at a point where the rock is to be broken down. Then the hammer piston of the implement delivers a blow at the tool which transmits the impact energy to the rock thereby breaking it. After a rock lump is broken away, the implement is set to a new position, and the next blow is delivered.

The broken rock is removed by means of a scraper and winch.

The abovedescribed machine for driving workings in hard rocks is rather a sophisticated apparatus having a large number of hydraulic jacks and pivotal joints. The percussive implement used in the machine has to be positioned in such a manner that its longitudinal axis and the axis of the tool aligned therewith should be directed substantially at right angles to the surface of the rock body at a point where a blow is to be delivered. When a lump of rock falls down after the blow, the end of the tool acting upon the rock may slip over the surface of the rock body at an angle substantially different from the right angle. This slippage can be the cause of substantial dynamic loads acting upon all members of the machine which are only limited by the amount of yielding of these members so that they can fail.

The complicated structure of the machine and the abovedescribed phenomenon of slippage of the implement tool substantially lower reliability of the machine.

The need to set the implement every time at right angles to the rock body entails substantial downtime for setting the implement before each blow so that efficiency of rock breaking is rather low.

Also known in the art is a machine for driving workings in hard rocks (cf. U.S. Pat. No. 4,300,802, Int. Cl. E 21 C 29/28, publ. Nov. 17, 1981), comprising a movable carrier which can move over the working floor and which is the base member for supporting all other members of the machine. Installed on this carrier is a fork-shaped boom mounted for rotation in a horizontal plane with respect to the carrier by means of two hydraulic cylinders. A frame is mounted between the legs of the boom for rotation in a vertical plane with respect to the boom under the action of two other hydraulic cylinders. The frame has four openings with guide surfaces in its walls, and support members are slidable along the guide surfaces. The support members have holes in which are rotatably received pins on which an implement is mounted. The implement is in the form of a high-energy "shot"-type implement, i.e. one in which the hammer piston does not touch the rock face of a working being driven before the moment the blow is delivered.

Two groups of shock-absorbing means are secured to the frame symmetrically with respect to a plane drawn at right angles to the implement longitudinal axis and passing along the axes of the pins in such a manner that each of the support members is held on either side against sliding along the guide surfaces by tappets of said shock-absorbing means.

The shock-absorbing means are intended to reduce forces transmitted from the implement to the other members of the machine in case of oblique blows and idle strokes of the hammer piston of the implement, as well as to maintain the present direction of the longitudinal axis of the implement after occurrence of such phenomena. Each shock-absorbing means comprises two oppositely arranged pneumatic cylinders whose rods are essentially tappets provided with pistons entering cylinder spaces filled with a compressed gas.

In the process of the implement operation a considerable part of blows delivered by the hammer piston thereof at the face are oblique ones, i.e. such blows the direction of which does not coincide with the normal to the rock surface in the spot the blow is delivered to. The oblique blow is always followed by a lateral recoil. In case of a lateral recoil in a horizontal plane the implement turns about its vertical axis on a pair of respective pins rotating in the support members located above and below the implement. The support members located on the sides of the implement slide in their guides and act upon the tappets of the shock-absorbing means. At the end of lateral recoil when the implement rotation ceases, the implement acted upon by the shock-absorbing means turns in the opposite direction. The lateral recoil in a vertical plane happens in the similar way. If the lateral recoil occurs in a plane laying between the horizontal and vertical planes, two vertical and two horizontal shock-absorbing means jointly come into play.

When the hammer piston performs an idle stroke fully or partly, i.e. when the hammer piston does not hit at the rock face during its forward movement, or if the hammer piston does not have time to spend its energy completely for breaking the rock, the implement will tend to move forward to follow the hammer piston and will act, through its pins and support members put thereon, upon the tappets of the front-end group of the shock-absorbing means. After the implement movement is completed, the reverse process takes place and, under the action of the tappets of the front-end group of the shock-absorbing means, the implement is returned to its initial position.

In the abovedescribed situations, when a force is applied to the tappet of the shock-absorbing means, the tappet moves within a cylindrical space and additionally compresses with its piston compressed gas which is available in that space. Any lateral recoil or idle stroke of the implement will be thus dampened by compression of gas in the cylindrical space of the shock-absorbing means. Under the action of the compressed gas the tappets will return the implement into the initial position.

It should be, however, noted that when the shock-absorbing means are actuated, e.g. upon a lateral recoil, the compressed gas, when additionally compressed by the tappet piston, accumulates a considerable amount of energy and will give it up when the implement is returned into the initial position. This will result in the implement arriving at the initial position after gaining a substantial speed so that it will move further past the initial position and will act upon the opposite tappet, i.e. damped oscillations of the implement will occur. The oscillatory process will on the one hand result in a longer time of return of the implement to its initial position and, one the other hand, it will cause an increase in the rate of wear of the shock-absorbing means. this disadvantage is conducive to a lower efficiency and shorter service life of the machine.

DISCLOSURE OF THE INVENTION

The invention is based on the problem of providing a machine for driving workings in hard rocks having a percussive implement, wherein shock-absorbing means are capable of dampening oscillations of the implement upon oblique lows and idle strokes of the hammer piston so as to improve efficiency and prolong service life of the machine.

The invention resides in that in a machine for driving workings in hard rocks, comprising a movable carrier mounting for rotation in a horizontal plane a swinging boom carrying at the end thereof a frame rotatable in a vertical plane, which frame mounts an implement for a limited rotation in horizontal and vertical planes and for a limited axial movement, the implement having a hammer piston which directly acts upon the rock for breaking it, the implement being mounted in the frame by means of pins having support members mounted in guide members and cooperating with piston rods of at least two shock-absorbing means which are mounted in the frame opposite to each other and comprise cylinders designed to take-up, and compensate for undesired displacements of the implement and for returning it to a pre-set position, according to the invention, each shock-absorbing means comprises an actuator space filled with a compressible fluid under pressure in which is received an end face of a piston rod remote from the support member cooperating with the piston rod, and first and second dashpot spaces filled with a non-compressible fluid and communicating with each other through a throttling means, and the piston rod has at least one enlarged piston like portion acting upon the non-compressible fluid so as to make it overflow through the throttling means between the first and second dashpot spaces during the piston rod movement.

This construction of the machine for driving workings in hard rocks makes it possible to avoid oscillations of the implement when it is displaced from its pre-set position under the action of lateral recoils and idle strokes of the hammer piston. Efficiency and durability of the machine are thereby enhanced.

It is preferred that the enlarged piston-like portion in the machine according to the invention be made in the form of an annular projection of the piston rod extending through a dashpot which is divided into the first and second dashpot spaces by the annular projection.

This construction of the shock-absorbing means makes it possible to minimize the length of the throttling means and to ensure the filling of the dashpot with liquid thereby enhancing reliability and durability of the machine.

It is also preferred that the throttling means comprise a space between the outer periphery of the annular projection and the inner surface of the dashpot, the inner surface of the dashpot being preferably conical, the larger base of the cone being on the side of the support member cooperating with the piston rod.

This embodiment of the throttling means is simple enough and convenient in manufacture; it prevents clogging and allows an about constant pressure to be maintained in one space of the dashpot during the entire shock-absorbing period, i.e. the shock-absorbing means exhibits a substantial energy absorbing capacity with minimum loads applied to members of the shock-absorbing means so that it can efficiently dampen possible oscillations of the implement.

The shock-absorbing means of the machine according to the invention may be made in such a manner that the piston rod has two enlarged piston-like portions at the ends thereof and extends through the dashpot having on its inner surface an annular projection which is disposed between the enlarged piston-like portions of the piston rod and divides the dashpot into the first and second dashpot spaces.

This construction of the shock-absorbing means makes it possible to lower to a certain extent pressure of the compressible fluid in the actuator space which, in turn, results in a longer life of respective sealing members and enhanced durability of the machine as a whole.

In the foregoing embodiment of the invention, it is preferred that the throttling means be made in the form of a space between the inner surface of the annular projection of the dashpot and the outer periphery of the piston rod extending between its two enlarged piston-like portions, the surface of the piston rod being conical, the larger base of the cone being on the side of the enlarged piston-like portion disposed on the side of the support member cooperating with the piston rod.

This construction of the throttling means of the shock-absorbing means facilitates the formation of the conical surface and makes it possible to improve accuracy in providing the varying cross-section of the throttling means thus improving operation of the shock-absorbing means as a whole.

In any embodiment of the machine, it is preferred that a space be provided in the piston rod of each shock-absorbing means, said space communicating with the actuator space.

The provision of such space in the piston rods results in an increase in the volume of compressible fluid taking part in operation of the shock-absorbing means thus lowering pressure fluctuations occurring in the actuator space upon actuation of the shock-absorbing means. This facility also improves conditions for operation of sealing members and prolongs life of the shock-absorbing means.

Preferably the actuator spaces of all shock-absorbing means communicate with one another.

The communication between the actuator spaces of all shock-absorbing means facilitates their filling with compressible fluid and further lowers pressure fluctuations in compressible fluid in the actuator spaces of the shock-absorbing means upon their actuation.

It is preferred that the second spaces of the shock-absorbing means into which non-compressible fluid overflows after the throttling be interconnected and connected to a means for maintaining continuous circulation of the non-compressible fluid.

The interconnection of the second spaces of the shock-absorbing means and their connection to the means for maintaining continuous circulation eliminates the possibility of operation of shock-absorbing means without non-compressible fluid and makes it possible to avoid overheating of fluid being throttled with frequent actuations of the shock-absorbing means.

BRIEF DESCRIPTION OF THE DRAWINGS

Objects and advantages of the invention will become apparent from the following description of specific embodiments illustrated in the accompanying drawings, in which.

BEST MODE FOR CARRYING OUT THE INVENTION

Figure 1:
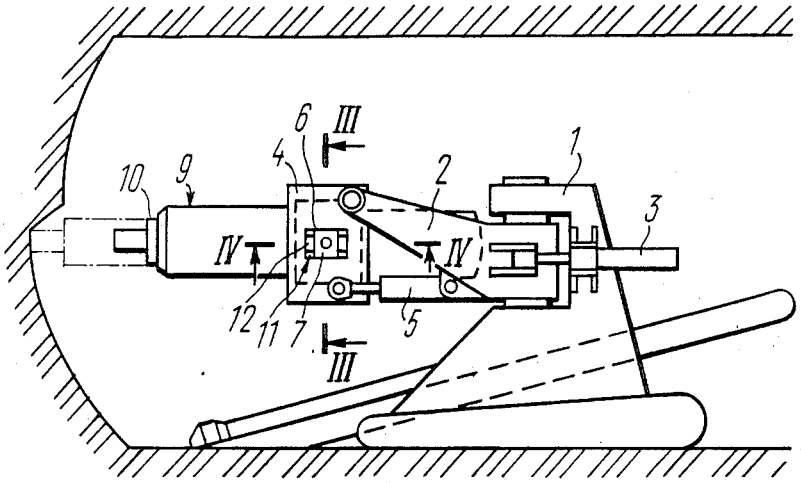
FIG. 1 is a side view of a machine for driving workings in hard rocks according to the invention in a working shown in longitudinal section.
Figure 2:
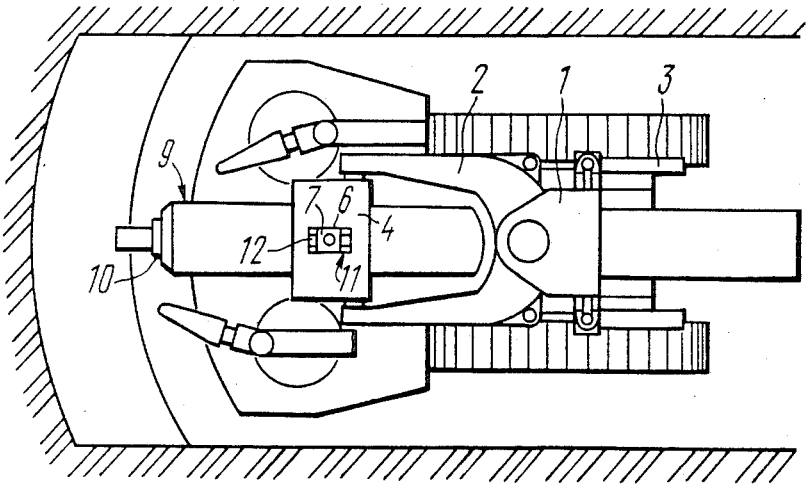
FIG. 2 is a plan view of the machine shown in a working being driven.
Figure 3:
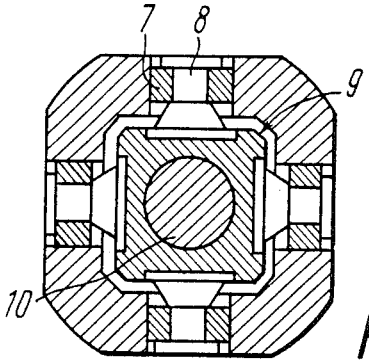
FIG. 3 is a sectional view taken along line III—III in FIG. 1.
Figure 4:
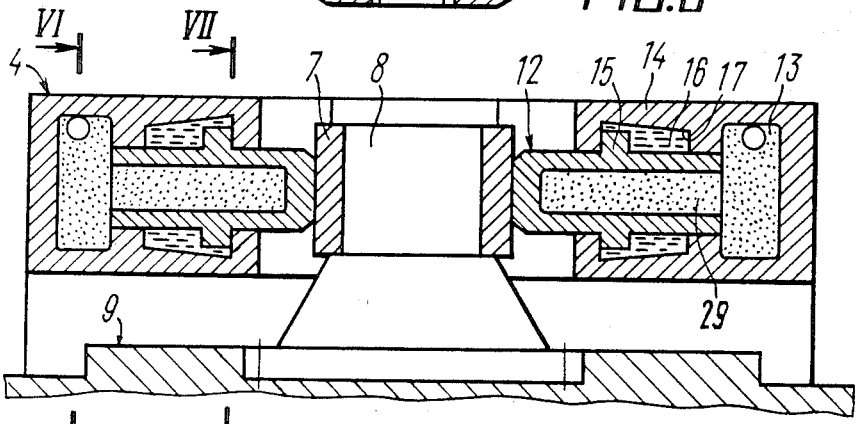
FIG. 4 is a sectional view taken along line IV—IV in FIG. 1.

A machine for driving workings in hard rocks according to the invention comprises a movable carrier 1 (FIGS. 1,2) which is capable of moving over the working-floor. The carrier 1 has a boom 2 mounted on a vertical pivot pin for rotation in a horizontal plane under the action of hydraulic cylinders 3. A frame 4 is secured at the end of the boom 2 for rotation in a vertical plane by means of hydraulic cylinders 5 (FIG. 1). Four openings 6 (FIGS. 1, 2) are provided in walls of the frame 4, and support members 7 are movable back and forth in the openings. The suppport members 7 (FIGS. 3,4) are made with holes in which are rotatably received pins 8 supporting an implement 9 (FIGS. 1,3). Axes of rotation of the opposite pins 8 (FIG. 3) are aligned and extend at right angles to the longitudinal axis of the implement 9. The latter comprises a high energy percussive "shot"-type tool wherein a hammer piston 10 does not touch the face until a blow is delivered.

Two groups of shock-absorbing means 11 (FIG. 1) are mounted on the frame 4 symmetrically with respect to a plane drawn through the axes of the pins 8 at right angles to the longitudinal axis of the implement 9 in such a manner that each of the support members 7 is held against displacement in the opening 6 by piston rods 12 of two shock-absorbing means 11 disposed opposite to each other.

The shock-absorbing means 11 are designed for lowering loads acting upon various members of the machine and imparted by the implement 9 during oblique blows or idle strokes of the hammer piston 10 and for restoring the pre-set position of the longitudinal axis of the implement 9 after such undesired events.

Each shock-absorbing means has the piston rod 12 (FIG. 4) having one end thereof cooperating with the support member 7, the other end being received in an actuator space 13 filled with a compressible fluid. The piston rod 12 may be hollow on the side of the actuator space 13 to form an interior space 29 so as to somewhat increase the volume of the space and to lower weight of the piston rod 12. A dashpot 16 is defined in a casing 14 of the shock-absorbing means, which receives an annular projection 15 of the piston rod 12. The peripheral surface 17 of the dashpot 16 is conical, the larger base of the cone being on the side of the support member 7. The dashpot 16 is filled with a non-compressible fluid.

Another embodiment of the shock-absorbing means (see FIG. 5) involves a piston rod 18 having two enlarged piston-like portions 19 and 20, the inner surface of a dashpot 21 having an annular projection 22, and an annular space between the inner surface of the annular projection and the outer periphery 23 of the piston rod 18 extending between the enlarged piston-like portions 19 and 20 defines a throttling means for non-compressible fluid when it overflows from one space of the dashpot 21 to the other space thereof during operation of the shock-absorbing means. The peripheral surface 23 of the piston rod 18 is conical, the larger base of the cone being on the side of the support member 7. Similarly to the abovedescribed embodiment, the piston rod 18 of the shock-absorbing means may be hollow to form an interior space 30, with the interior space open on the side of an actuator space 24 filled with a compressible fluid.

The provision of the dashpot in shock-absorbing means provides for the conversion of kinetic energy of the implement upon its rotation at the moment of lateral recoil or forward movement upon an idle stroke of the hammer piston into thermal energy of the fluid being throttled with subsequent dissipation of thermal energy.

Figure 6:
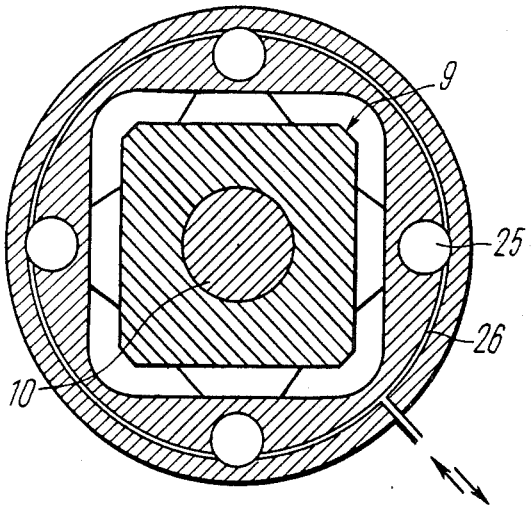
FIG. 6 is a sectional view taken along line VI—VI in FIG. 4.
Figure 7:
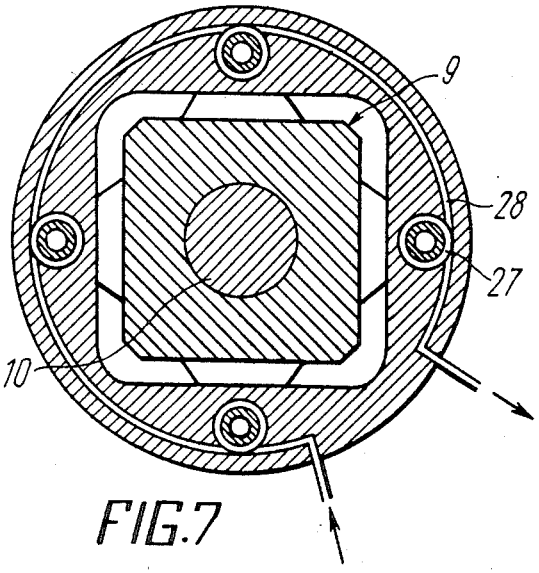
FIG. 7 is a sectional view taken along line VII—VII in FIG. 4.

To faciliate filling of actuator spaces 25 (FIG. 6) with a compressible fluid under pressure, these spaces are interconnected by a passage 26. For filling dashpots 27 (FIG. 7) with noncompressible fluid and for continuous replacement of non-compressible fluid so as to eliminate its overheating during throttling, the dashpots 27 communicate with one another through a passage 28 and are connected to a means for maintaining continuous circulation of non-compressible fluid (not shown in the drawing).

The machine for driving workings in hard rocks according to the invention functions in the following manner.

The machine moving through the working is moved up closer to the working face at a desired distance therefrom. Then the hammer piston 10 (FIG. 1) of the implement 9 is aimed at the desired point of the face by means of the hydraulic cylinders 3 and 5, and the implement 9 is actuated so that its hammer piston 10 delivers a necessary number of blows for breaking-down the rock to a desired depth. Then the implement 9 is aimed at a next point, and the cycle is repeated. The muck is removed using known loaders which may or may not be a part of the machine.

Therefore, during normal operation of the machine the shock-absorbing means remain inactive without, however, interfering with operation of the main elements of the machine.

The shock-absorbing means will come into play upon a lateral recoil of the implement 9 in case of an oblique blow or upon an idle stroke of the hammer piston 10.

At the moment of an oblique blow, then the direction of the movement of the hammer piston 10 does not coincide with a line drawn at right angles to the surface of the rock being worked at the point of blow delivery, a force directed at right angles to the axis of the implement 9 will act upon the hammer piston 10 on the rock body side.

The implement 9 is turned under the action of this force so that a lateral recoil occurs. During the lateral recoil in a horizontal plane, the implement 9 is turned about a vertical axis extending through the pair of vertical pins 8 disposed above and below the implement 9. At that moment the implement 9 will, through the pair of horizontal pins 8, cause the respective support members 7 disposed on either side of the implement 9 to move in opposite directions (forward and backward) and they will, in turn, act upon the piston rods 12 of the shock-absorbing means 11 to cause them to move.

The lateral recoil of the implement 9 in a vertical plane will occur in the same manner.

In case the hammer piston 10 of the implement 9 does not meet any obstacle during the delivery of a blow (e.g. in case of a fall out of a large lump of rock after the foregoing blow) or in case the rock at which the blow is delivered proves to be too weak so that it cannot absorb the full energy of the hammer piston 10, an idle stroke of the hammer piston takes place. The hammer piston acts upon the casing of the implement 9 to cause it to move forward. The implement 9 will move to act through its pins 8 and support members 7 upon the front-end group of the piston rods 12 of the shock-absorbing means 11 so as to cause them to move in the same direction.

Each shock-absorbing means 11 functions in the same manner both upon a lateral recoil of the implement 9 and an idle stroke of the hammer piston 10. As an example, the reference is made to the operation of the right-hand shock-absorbing means shown in FIG. 4. During movement of the pin 8 to the right as shown in the drawing, it well act through the associated support member 7 upon the piston rod 12 to cause it to move in the same direction. The displacement of the piston rod 12 will cause an additional compression of fluid in the actuator space 13. At the same time, the annular projection 15 will force the non-compressible fluid from one space of the dashpot 16 extending between this projection and the wall of the dashpot 16 separating it from the actuator space 13 into the other space of the same dashpot 16 defined by the annular projection 15 and the dashpot wall on the side of the support member 7. The overflow of the non-compressible fluid from one space of the dashpot 16 into the other space thereof occurs through the space between the outer periphery of the annular projection 15 and conical surface 17 of the dashpot 16. It should be noted that as the piston rod 12 continues to move, its speed decreases and, at the same time, the cross-sectional area of the throttling space also decreases due to the decrease in diameter of the surface 17 so that the pressure difference during throttling will remain substantially unchanged thus ensuring maximum possible energy absorption through the pre-set shock-absorbing length. The above-described movement of the piston rod 12 continues until the moment at which kinetic energy of movement of the implement has been partly converted into energy of additional compression of compressible fluid in the actuator space 13 and partly into thermal energy of fluid being throttled.

When the implement 9 is stopped under the action of pressure of compressible fluid upon the piston rods 12 on the side of the actuator space 13, the piston rods 12, support members 7, pins 8, and the implement 9 will move back to the initial position. With a proper choice of all parameters of the shock-absorbing means, the return movement will occur exactly to the initial position of the implement 9 so that no oscillations will occur.

It is apparent from the description of operation of the shock-absorbing means that it is the provision of the dashpot 16 filled with a non-compressible fluid and movement of the annular projection 15 therein that constitute the cause of an irreversible absorption of energy of undesired displacements of the implement 9.

Figure 5:
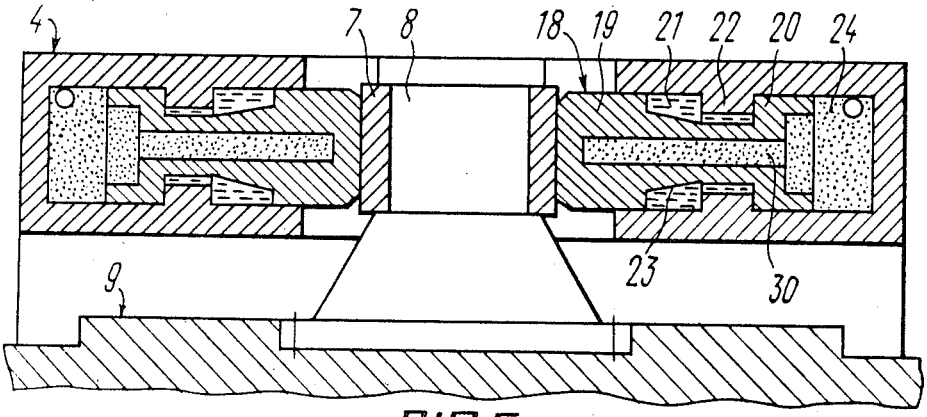
FIG. 5 shows an embodiment of shock-absorbing means having piston rods having two enlarged piston-like portions.

The embodiment of the shock-absorbing means shown in FIG. 5 functions similarly to that described above. The only difference is that non-compressible fluid is forced from one space of the dashpot 21 into the other space thereof under the action of the enlarged piston-like portion 19 of the piston rod 18, through the space between the conical periphery 23 of the piston rod 18 and the inner surface of the annular projection 22, the second space of the dashpot 21 being defined by the annular projection 22 and the enlarged piston-like portion 20 of the piston rod 18.

In this embodiment pressure of compressible fluid in the actuator space 24 may be somewhat reduced and the throttling space size may be increases without changing the general characteristics of the shock-absorbing means. This results in an improvement of conditions for operation of members of the shock-absorbing means so as to enhance its durability.

INDUSTRIAL APPLICABILITY

The machine according to the invention may be most advantageously used with high energy implements for crushing lumps of rock and other rock-like materials and also for explosion-less driving of workings in hard rocks.

Thus a machine with a high energy hammer with an impact energy of 100 kJ designed according to the invention is capable of crushing oversized stones of several cubic meters in size with 1–2 blows at a capacity of 20 $m^3/h$ and even greater.

The machine is very efficient and highly reliable in operation.

We claim:

1. A machine for driving workings in hard rocks, comprising a movable carrier;

a swinging boom mounted for rotation in a horizontal plane on said movable carrier;

a frame rotatable in a vertical plane carried at an end of said swinging boom;

an implement mounted on said frame for a limited rotation in horizontal and vertical planes and for a limited axial movement;

a hammer piston extendable from said implement to act directly upon the rock for breaking the rock;

pins mounting said implement in said frame;

support members arranged about said pins to support said pins in said frame so that each of said pins is rotatably received within one of said support members, each of said support members received for sliding within an opening in said frame;

at least two shock-absorbing means;

piston rods of the at least two shock-absorbing means coaxially mounted opposite to each other in the frame, first ends of the piston rods engaging one of said support members;

cylinders within which said piston rods are axially movable for taking up undesired displacements of the implement and for returning the implement to a pre-set position wherein each shock-absorbing means comprises a casing including an actuator space filled with a compressible fluid under pressure and receiving an end of one of said piston rods, the end being remote from the first end of the piston rod; and first and second dashpot spaces filled with a non-compressible fluid and provided within said casing, said piston rod preventing fluid communication between said dashpot spaces and said actuator space;

throttling means through which the first and second dashpot spaces communicate with each other;

at least one enlarged piston-like portion on the piston rod acting upon the non-compressible fluid so as to cause it to flow through the throttling means between the first and second dashpot spaces during movement of the piston rod.

2. A machine according to claim 1, characterized in that the enlarged piston-like portion comprises an annular projection of the piston rod in a dashpot which is divided by the annular projection into the first and second dashpot spaces.

3. A machine according to claim 2, characterized in that the throttling means comprises a space between the outer periphery of the annular projection and an inner surface of the dashpot, the inner surface of the dashpot being conical, the larger base of the cone being closer to the support member than the smaller base thereof.

4. A machine according to claim 1, characterized in that each piston rod comprises two enlarged piston-like portions at opposite ends thereof and extends through a dashpot having on the inner surface thereof an annular projection extending between the enlarged piston-like portions of the piston rod and dividing the dashpot into the first and second dashpot spaces.

5. A machine according to claim 4, characterized in that the throttling means comprises a space between the inner surface of the annular projection of the dashpot and the outer periphery of the piston rod extending between the enlarged piston-like portions, the surface of the piston rod being conical, with the larger base of the cone being adjacent of one of the enlarged piston-like portions which is closer to the support member.

6. A machine according to claim 1, characterized in that the piston rod of each shock-absorbing means is hollow so that a space is formed in the piston rod, the space communicating with the actuator space.

7. A machine according to claim 1, characterized in that the actuator spaces of the shock-absorbing means communicate with one another.

8. A machine according to claim 1 characterized in that the second dashpot spaces of the shock-absorbing means into which the non-compressible fluid flows after the throttling communicate with one another and are connected to a means for maintaining continuous circulation of the non-compressible fluid.

* * * * *